US005899211A

United States Patent [19]

Brown

[11] Patent Number: 5,899,211

[45] Date of Patent: May 4, 1999

[54] APPARATUS AND METHOD FOR SECURING PONY TAIL

[75] Inventor: Thomas A. Brown, Fairfield, Iowa

[73] Assignee: Pony Pal, L.C., Fairfield, Iowa

[21] Appl. No.: 09/030,733

[22] Filed: Feb. 25, 1998

[51] Int. Cl.[6] ..... A41G 3/00

[52] U.S. Cl. ..... 132/201; 132/53; 132/273

[58] Field of Search ..... 132/53, 55, 201, 132/273, 275

[56] References Cited

U.S. PATENT DOCUMENTS

| | | | |
|---|---|---|---|
| D. 32,146 | 1/1900 | Leick . | |
| D. 52,258 | 8/1918 | Upton . | |
| 57,328 | 8/1866 | Iverson . | |
| D. 59,261 | 4/1921 | Muller | 132/53 |
| D. 229,240 | 11/1973 | Fox . | |
| D. 273,341 | 4/1984 | Rol . | |
| D. 273,342 | 4/1984 | Rol . | |
| D. 368,983 | 4/1996 | Gruters et al. . | |
| 541,125 | 6/1895 | Simonson . | |
| 1,713,616 | 5/1929 | Oppenheim | 132/53 |
| 2,567,119 | 9/1951 | Naidor | 132/53 |
| 2,651,310 | 9/1953 | Selson | 132/53 |
| 2,847,016 | 8/1958 | Rabinowitz . | |
| 3,000,384 | 9/1961 | Piers, Jr. . | |
| 4,600,029 | 7/1986 | Ueberschaar | 132/53 |
| 4,830,029 | 5/1989 | Bird | 132/53 |
| 5,303,724 | 4/1994 | Anzivino | 132/53 |
| 5,465,741 | 11/1995 | Dvorak . | |
| 5,501,239 | 3/1996 | Walker | 132/53 |
| 5,551,452 | 9/1996 | Barlow | 132/53 |

OTHER PUBLICATIONS 4 pgs. of magazines including Modern Salon, May 1997 p. 169, Modern Salon Magazine; May 1997.

Pg. 169 Modern Salon Magazine; May 1997.

Pg. 52, Sophisticate's Hairstyle Guide; Jun. 1996.

Pg. 77, Hair Cut & Style magazine; Date: Unknown; Advertisment for "Hair Band–it#".

*Primary Examiner*—Todd E. Manahan

*Attorney, Agent, or Firm*—Zarley, McKee, Thomte, Voorhees & Sease

[57] ABSTRACT

An artificial hair piece includes an independent extension of synthetic human hair secured at one end to a stretchable, twistable, and foldable elastic loop or band. The opposite end of the extension can either be free or can be gathered and tied or otherwise bound. The elastic loop can be used to secure gathered actual hair of a user into, for example, a ponytail. The hair extension can then be wrapped around the elastic loop to hide it from view and give the impression that the hair extension is securing the ponytail in place. The hair extension can be selected to match one or more characteristic of the user's own hair.

21 Claims, 3 Drawing Sheets

APPARATUS AND METHOD FOR SECURING PONY TAIL

BACKGROUND OF THE INVENTION

A. Field of the Invention

The present invention relates to hair styling, and in particular, to devices and methods of adding artificial hair pieces to a person's own natural hair, for example, in securing, wrapping, and styling pony tails.

B. Problems in the Art

A currently popular, but long used, hair style is the pony tail. The person's hair is gathered and secured by a rubber band or other looped elastic device at a location at or near the person's head, all as is well-known.

There are actually many variations of pony tails or similar hair configurations. For example, the place of gathering and securing the pony tail (hereafter referred to as the "base" of the pony tail) can be at the lower back of the head, or in the back of the head but quite high on the head. Another example is "pig tails" or double pony tails, usually spaced laterally towards opposite sides of the back of the head. Therefore, for purposes of this description, the term pony tail is intended to mean traditional pony tails and any similar or analogous hair configuration where actual hair is gathered and secured at a base near the head in a gathered configuration then extends either freely, braided, or otherwise away from the base.

As mentioned, the pony tail is secured most times by a rubber band or elastic member. To secure and maintain the pony tail, the elastic or rubber band must be wound tightly around the hair. Since the rubber band or elastic member is usually a loop, the hair gathered for the ponytail is most times first threaded through the loop, the loop is twisted to form another loop (the first loop surrounding the gathered hair) and the outer end of the gathered hair is threaded back through the second loop, and so on until the base of the pony tail is tightly secured. As a result, the band or elastic is usually visible.

Some people cover the elastic with a ribbon, bow, or other ornamentation. There are devices that attempt to combine the securing function of elastic with an ornamental aspect. An example is called a "scrunchie", which basically consists of an elastic material in a loop covered with a decorative elastic or gathered loose fitting cloth-like material. Even though the device must be wrapped like a rubber band is wrapped around the pony tail, when in place it is usually more appealing than simply a rubber band or elastic loop. Many times a smaller rubber band or elastic loop must first be used to secure the pony tail and the decorative scrunchie is then placed over it.

An alternative and presently increasingly popular way to cover the band or elastic is to use some of the person's own hair. There are different ways to do so, but one way to do so is described and shown at page 169 of MODERN SALON magazine, May 1997 issue. After the pony tail is created, by use of an elastic band (and possibly a hair pin), a narrow section of the person's own hair from the base of the ponytail is pulled out, saturated with hair spray and wrapped around the elastic band. It is sprayed again with hair spray and secured in place, by one or more hair pins, for example. The person's own hair, therefore, conceals the elastic securing the base of the pony tail and makes an appealing style. The arrangement also gives the illusion that the person's own hair was used to create and secure the pony tail.

The above method is fairly time-consuming. It also requires the use of substantial hair spray. Furthermore, although the hair will perfectly match because it is the user's own, that part of the hair used to wrap the elastic must be manipulated, stretched and styled into a tightly wound configuration, which risks damage to the hair. It also treats that portion of the hair much differently than adjacent portions. Therefore, when not worn as a wrap around the base of the pony tail, it may look different than other adjacent portions of the person's hair. In addition, it is desirable to exhibit the maximum thickness of hair in the pony tail, and this method detracts from the visible volume in the pony tail by the amount of hair used to create the wrap at the base.

A variety of devices are commercially available to be used generally with hair styling. For example, the Tristar "HAIR-DINI" (Tristar of 1616 Duke Street, Laureldale, Pa. 19695) is a flexible apparatus with foam faces that can be shaped to hold and configure hair in various fashions. The "HAIR BAND-IT", available from Hair Band-It, P.O. Box 210428, Bedford, Tex. 76095, a current hair styling device bearing a patent number of U.S. Pat. No. 5,417,230, appears to be a tool that can assist a person to wrap their own hair around the elastic of their pony tail.

Revlon, Miami Lakes, Fla. 33014, markets a device called Revlon "SPARE HAIR" which appears to use an internal wire spine covered by artificial hair which could allow a user to wrap the artificial hair around the elastic creating the pony tail. It can also be used to add hair at any place on the user's head, if desired. The internal wire spine has flexible wire hooks at either end to assist in securing the device to the person's head. One use shown in advertising for "SPARE HAIR", is to wrap the elastic of a pony tail. Because it uses artificial hair, the user must match the artificial hair to the user's desired hair style and/or color. Also, the user must first secure the pony tail and then manipulate the wire spine and wire hooks, which is not easy or convenient.

However, none of the above-mentioned devices function both as the elastic to create the pony tail (i.e. bind the pony tail) and to create the look that the pony tail is wrapped in the person' own hair. Therefore, a need has been identified in the art. It would be advantageous to have the capability of creating and securing a pony tail and also wrap the elastic with what appears to be the user's own hair. Such a solution would not only be quick, but would not subject at least a portion of the user's hair to the trauma and stress of using it to create the wrap. Furthermore, it would be easier to change hair styles and give more options for hairstyles. This would eliminate substantial amounts of preparation time. Normally, a good job of wrapping the elastic with one's own hair requires a trip to the hair salon, which involves substantial time and cost.

U.S. Pat. No. 541,125 to Simonson is entitled "Hair Structure" and discloses one or more rings of what he calls elastic or flexible material such as very thin spring steel, or brass, or whale bone. Hair is sewed, or tied, or secured to entirely enclose and conceal the foundation, i.e. the ring or rings. The ring or rings are in turn secured in a parting of the user's hair close to the head by pins or placed over a knot of the user's hair. The user's own intact hair is then dressed in with the artificial hair to create a foundation and appearance of fuller hair or more volume in the user's hair.

U.S. Pat. No. 5,465,741 to Dvorak is entitled "Hair Wrap Device" and discloses a fabric sheet having an elastic band attached to one end. The elastic band is secured around a user's pony tail. The fabric wrap hangs down in the direction of the pony tail, is wrapped around it, and secured by what are called lace members. Neither of the above patents discloses or suggests an integrated elastic loop/artificial hair combination for securing and wrapping the base of a pony tail. Simonson's ring would not operate if it where an elastic loop that is flexible, foldable, twistable, and stretchable. Its ring is a foundation, a base or support, over which the artificial hair and the user's intact hair are laid and dressed. Dvorak has no teaching of use of artificial hair, but rather is limited to a cloth wrap along a substantial length of the user's pony tail, secured by laces.

It is therefore a principle object of the present invention to provide an apparatus and method of wrapping the elastic of a pony tail or similar hair arrangement with hair, and more specifically, artificial hair or other than the user's own hair, that improves over or solves the problems and deficiencies in the art.

Further objects, features and advantages of the present invention include an apparatus and method which:

1. is economical to manufacture.
2. is durable over repeated and long use.
3. is quick and easy to use without assistance.
4. is adaptable to a variety of hair styles, characteristics, and uses.
5. is non-complex in structure and use.

These and other objects, features, and advantages will become more apparent with reference to the accompanying specification and claims.

SUMMARY OF THE INVENTION

The present invention is an apparatus and method for creating the look of the user's own intact hair as the wrapping and securing of the user's pony tail. The method comprises creating and securing a pony tail or similar hair configuration of the user with artificial hair, other than the user's own intact hair connected and then wrapped about the area of creation and securement of the pony tail, to cover the area of creation and securement of the pony tail, also called the base of the pony tail.

The apparatus comprises a length of artificial hair, other than the user's intact hair, having a plurality of individual hair strands. First ends of the strands are connected to a pony tail securing member, one example being a loop of elastic material. The opposite or distal ends of the strands can be free or can include a second securing member; one example being a conventional hair pin or clamp.

The method and apparatus allow the user to both create and secure the pony tail and cover the area of securement with a simulation of the user's own intact hair and conceal the true method of creating and securing the pony tail.

DETAILED DESCRIPTION OF THE PREFERRED EMBODIMENT

Figure 1:
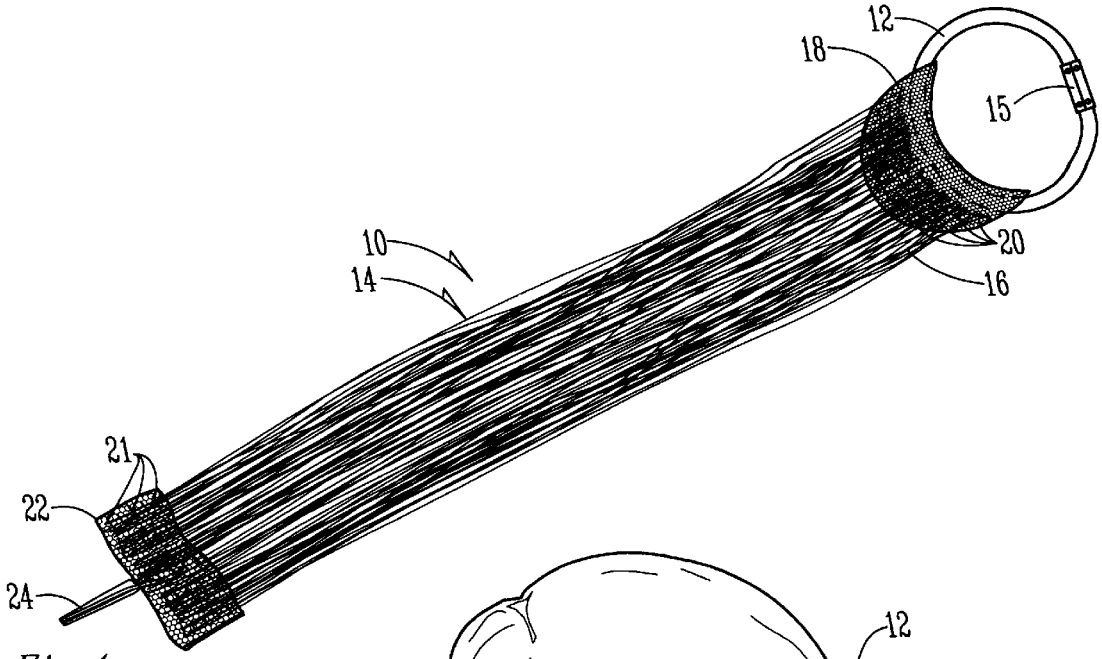
FIG. 1 is a perspective view of a preferred embodiment of the invention.

To provide a better understanding of the invention, which is defined solely by the claims appended hereto, exemplary embodiments of the invention will now be described in detail. Frequent reference will be taken to the drawings. Reference numerals are used in the drawings to indicate certain parts or locations. The same reference numerals will be used to indicate the same parts or locations in all of the drawings, unless otherwise indicated.

FIG. 1 illustrates a device 10, according to the present invention, generally. An elastic loop 12, hereafter referred to as the elastic 12, is a conventional elastic member used for creating pony tails. Elastic 12 is essentially a strand, ring, or band of elastic, such as rubber, enclosed or covered by an elastic fabric and joined end-to-end into a continuous loop by connecting fastener 15 (usually a small metal clasp or clamp). Elastic 12 can be on the order of one and one-quarter inches in diameter in a normal non-extended state. Any part of it is stretchable, foldable and twistable in any direction. Any part of it or its whole is expandable to several times its normal length while at the same time being foldable and twistable. A length of artificial hair or some one else's separated natural hair, or other than the user's intact natural hair, generally indicated by reference numeral 14, is made up of a plurality of individual hair strands. For the present purposes, the term artificial hair is intended to include in its meaning any hair, natural, simulated or synthetic, which is not intact and growing on the particular user's head. One end (see reference numeral 16) of length 14 is fixed to elastic 12. In this example, end 16 of length 14 is secured to a mesh or net portion 18 (by weaving the strands thereto or otherwise). Mesh 18 is then tied to elastic 12 by thread 20, for example. Other ways are possible.

The strands at the other end 22 of length 14 are even and bound together and a hair pin or clamp 24 can be fixed by tied thread 25 or otherwise, to end 22. The strands at end 22 can be bound by wrapping them in a rubber band (see reference numeral 26), by gluing them together, or by other methods. The distal ends of the artificial hair are sewn or fastened together with a pin or clamp parallel to the flow of the hair.

Device 10 therefore has a portion 12 which functions to create and secure a user's pony tail, in the same way an elastic or rubber band would conventionally do so, but then includes a length 14 of artificial hair which extends from portion 12 and can then be wrapped around portion 12 to both conceal portion 12 and appear as if the user's own intact hair created and secured the user's pony tail in place.

Figure 2:
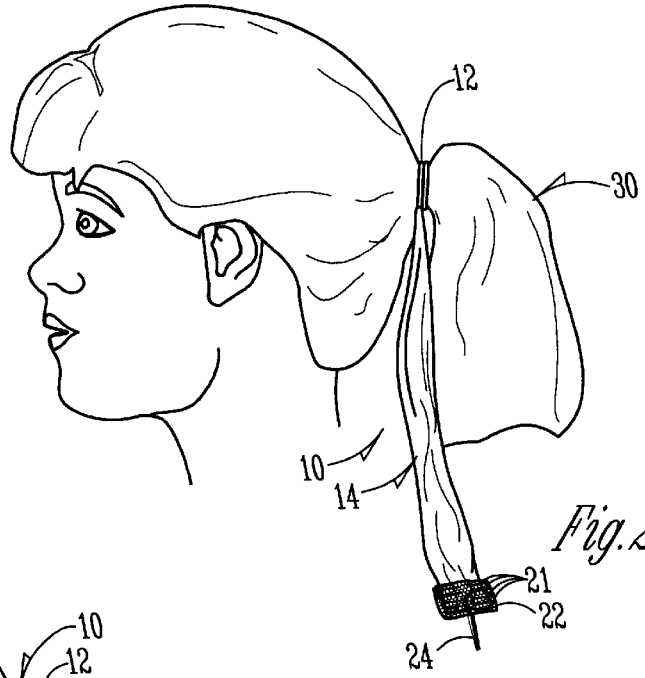
FIG. 2 is a diagrammatic depiction of a first or preliminary stage of use of the apparatus of FIG. 1 with a user's pony tail.
Figure 3:
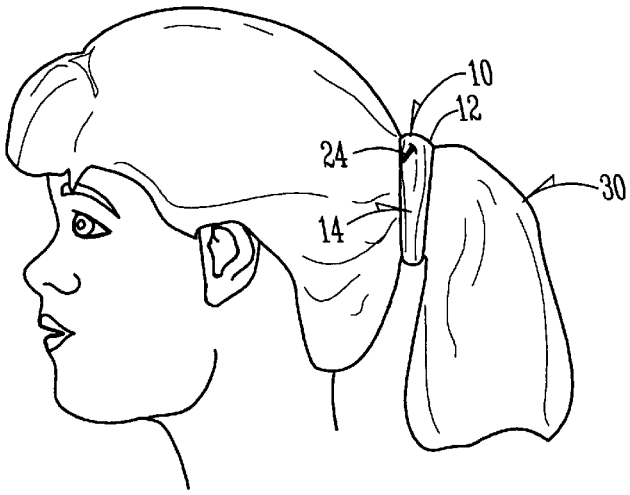
FIG. 3 is a diagrammatic depiction of a second or completed stage of use of the apparatus of FIG. 1.

FIGS. 2 and 3 illustrate the method according to the invention. In stage one (FIG. 2), a pony tail is created by gathering the user's hair in a fashion to preliminarily form a pony tail 30. The pony tail 30 is finally created and secured in place, here by using elastic 12 in a conventional manner. The pony tail 30 is inserted through the middle of elastic 12, which is then twisted. The pony tail 30 is then inserted through elastic 12 usually several more times so that elastic 12 is tightly wound around pony tail 30. At the end of stage one, the pony tail 30 is created and secured, and artificial hair length 14 simply hangs or extends from elastic 12, as shown at 14 in FIG. 2. Note that FIG. 2 shows elastic 12 wrapped twice at the base of the pony tail, but it could be once or more than two wraps depending on the size of elastic 12, the amount and thickness of the pony tail 30, and the tightness of the wrap.

Stage 2 (see FIG. 3) involves wrapping length 14 around the area of the creation and securement of the pony tail (its base), here around elastic 12. The portion of length 14 proximal to elastic 12 is wrapped first, and then succeeding portions of length 14 until its distal end. Elastic 12 is concealed and it appears that hair 14 created and secured the pony tail in place. Finally, the user secures end 22 in place, wound around elastic 12, by opening the jaws of hair pin 24, inserting the outer ends of the jaws into, through, and/or around the wrapped length of hair 14, and closing the jaws.

In the preferred embodiment, length 14 is artificial hair available at or through a variety of locations or sources, all well known in the art. Artificial hair 14 can be made of synthetic chemical fibers, such as either modacrylic, vinyl chloride, polyester, or polyamide. Polyamide is considered superior in many respects and is available from International Hairgoods, Inc. (a subsidiary of Aderans), 5909 Baker Rd., STE 505, Minnetonka, Minn. 55345. Alternatively, actual human hair could be used, as could certain animal hairs.

It will be normally true, it is believed, that users will select a length of hair 14 that is compatible, if not very close to, the user's hair color. It will be appreciated that other hair characteristic options may be desirable by users, such as hair texture, length of section 14, amount of hair in length 14, straightness or curliness, etc. However, the invention is not limited to matching the user's natural hair characteristics to the artificial hair. The user may desire the artificial hair 14 to be somewhat different in characteristic(s), including color, to the user's natural characteristic(s).

Figure 4:
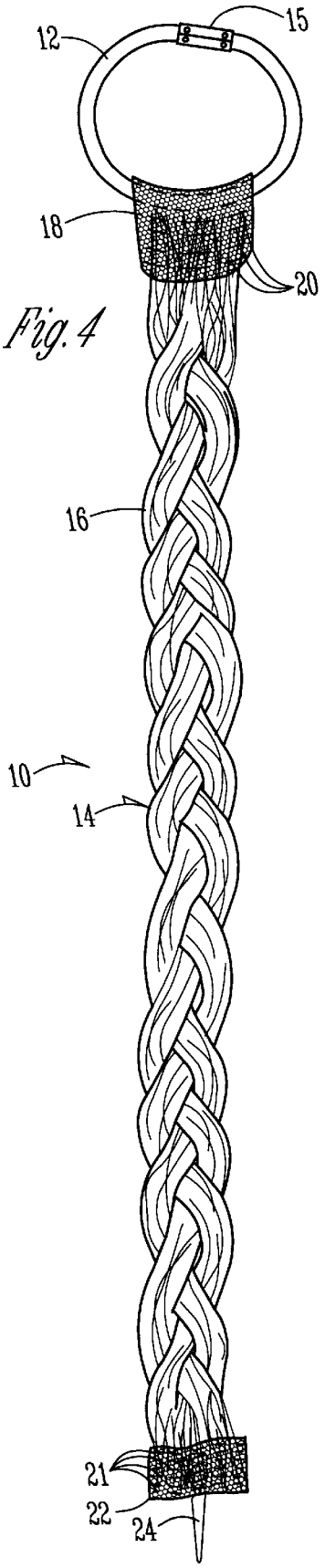
FIG. 4 is similar to FIG. 1 but shows an alternative embodiment to that of FIG. 1.
Figure 5:
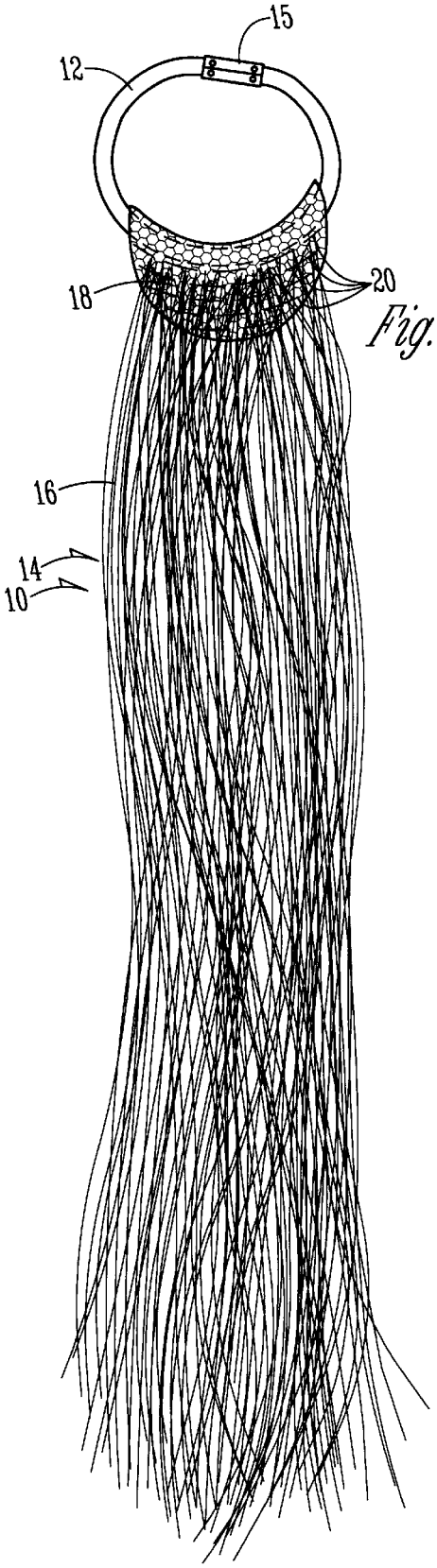
FIG. 5 is similar to FIG. 1 but shows an alternative embodiment to that of FIGS. 1 and 4.

FIGS. 4 and 5 illustrate other possible alternatives. In FIG. 4, it can be seen that length 14 is braided (for example, three or four strand braids, squared at the bottom). FIG. 5 shows that end 22 of length 14 does not necessarily have to be bound together, but rather could be free. The ends of the strands in end 22 could be used to secure end 22 in place, or a clamp or hair pin like discussed above, could do so.

The included preferred embodiments are given by way of example only, and not by way of limitation to the invention, which is solely described by the claims herein. Variations obvious to one skilled in the art will be included within the invention defined by the claims.

For example, elastics 12 are available and widely known and used for creating pony tails. It can be a conventional cloth-covered elastic ring approximately one and one-quarter inches in diameter in a normal, unextended state. The thickness of the elastic is approximately one-eighth inch in diameter. The inner material of the ring of elastic 12 is made of an elastic rubber material, and the surface can be, for example, nylon or polyester knitted cloth.

Synthetic hair extensions 14 are also well-known and available from a wide variety of commercial sources. They generally comprise synthetic hair strands secured at one end to a webbing or netting. Here, extensions 14 are on the order of seven or eight inches long or longer, but there is no precise limit or range. One example would be sixteen inches long by one-quarter inch wide, when the hair is bunched up. The free end of extension 14 is finished smooth. The ends are cut to a uniform length. Pin 24 can be a bobby pin, a double sided bobby pin, or other devices that could fix the ends of extension 14 in place when would around the base of the pony tail.

Extensions 14 could be available in a variety of hair colors and characteristics. The color of the elastic 12 can be matched or made similar to the color of the hair extension 14. The artificial hair strands of extension 14 can be of any suitable chemical fiber such as is used for artificial hair.

Webbing 18 can be made of synthetic materials suitable for use on a person's head. For example, nylon could be used. It can be selected to be the same or close to the color of the artificial hair 14. Two pieces, for example each one square inch in dimension, can be used.

Thread 20 can be polyester cord the same or similar in color to hair 14, and two inches long. Clip or pin 24 is approximately two inches long, with a loop in one end and opposed jaws biased towards one another, but other lengths and configurations are possible. All parts of device 10 could be color coordinated or color matched to each other and to the user's intact hair.

Figure 6:
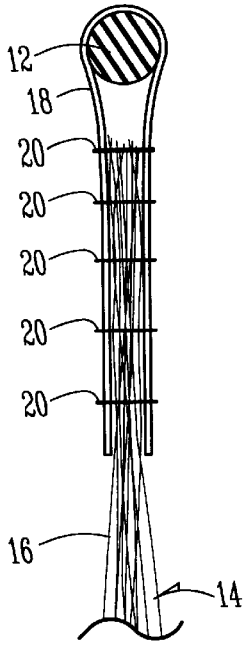
FIG. 6 is an enlarged diagrammatic view of a method of securement of opposite ends of the artificial hair in the embodiment of FIG. 1.
Figure 6:
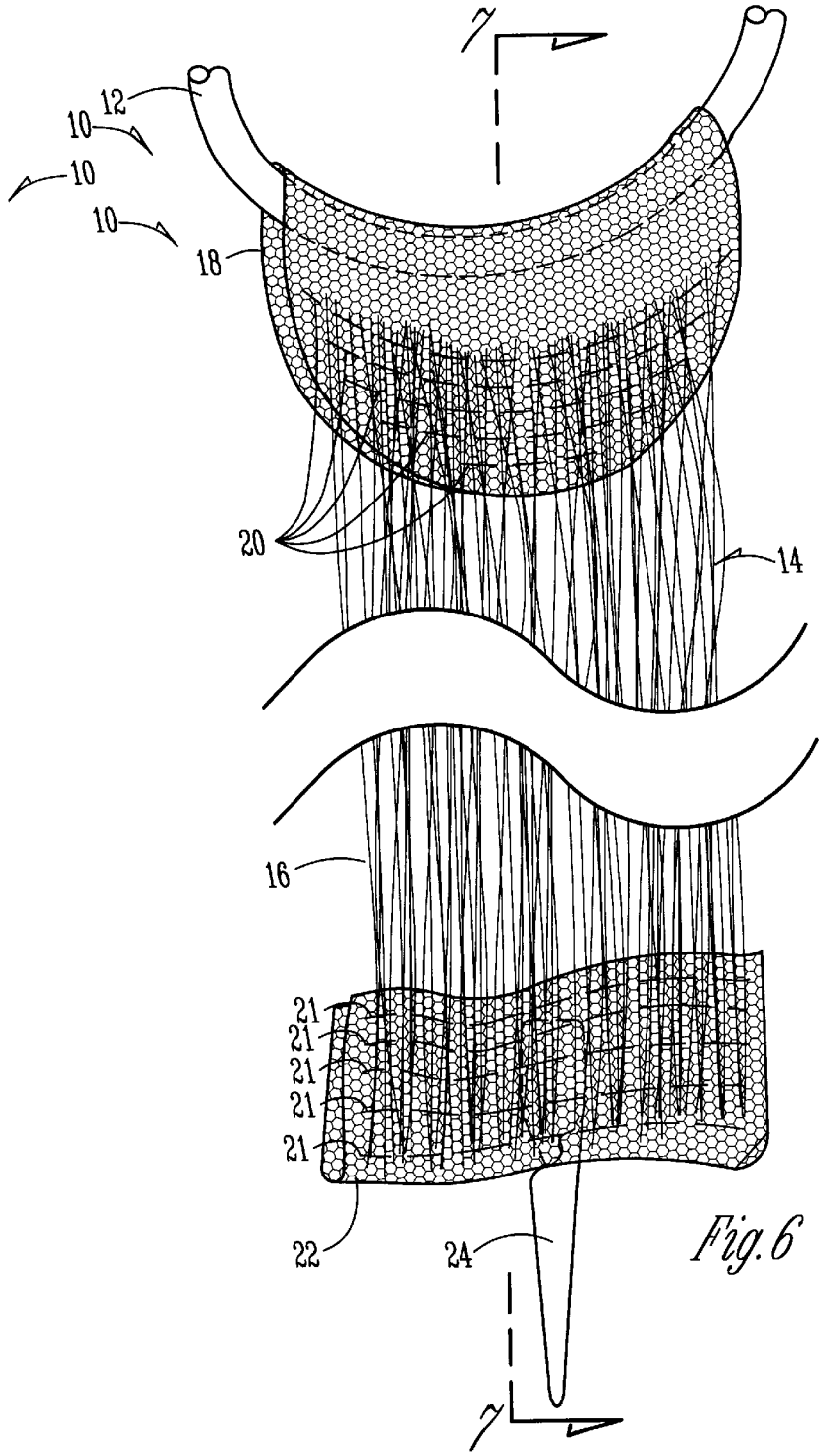
Figure 7:
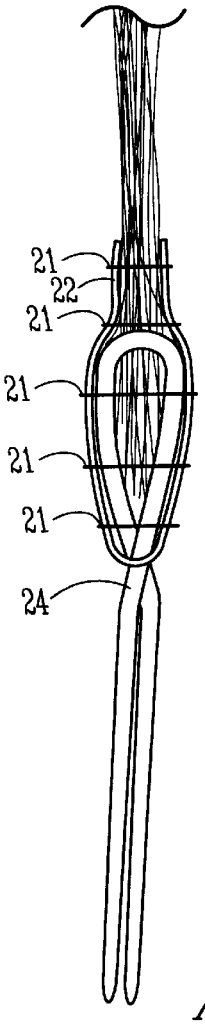
FIG. 7 is a partial sectional side elevation view of FIG. 6, taken along line 7—7 of FIG. 6.

Device 10 can be assembled and constructed as follows. Webbing 18 (one inch square, for example) is folded once over elastic 12. One end of the lock or extension of hair 14 is placed between the folded webbing 18 and extension 14 is perpendicular to a tangent drawn to the point on the elastic ring 12 in the center of the webbing 18 fold (i.e. the hair 14 points directly away form ring 12). Using thread 20 in a sewing machine, a stitch is repeated across the webbing and the hair to fasten the hair between the two sides of webbing 18. FIGS. 6 and 7 illustrate this in detail. Thus, at this point, one end of hair 14 is fastened securely to elastic ring 12.

Then, hair 14 can be bunched and secured at its opposite end. Alternatively, it could be slightly spread (see FIGS. 1, 4, and 5). A small piece of webbing (see 19 at FIGS. 6 and 7) like webbing 18 could be wrapped around that end. A small piece (e.g. two inches long) of polyester cord (like polyester thread or cord 20) could be threaded through the webbing at the free end of hair 14. (See FIGS. 6 and 7) Distal end of hair 14, polyester cord 20, and webbing 19 could be stitched or sewn together (see stitches 21 in FIGS. 6 and 7). A pin 24 could then be tied to the outer end of the cord to secure a pin 14 in place and have it always available. By using this method, no glue is used and hair extension 14 is secured at both ends. Alternatively, pin 24 could be fastened parallel to the hair 14 at or near its distal end, but not have a cord 20. Pin 24 could be tied to hair 14/webbing 19 or simply inserted in that orientation.

What is claimed is:

1. A removable hair piece comprising:

a length of hair strands having a first end and a second end;

an elastic loop which is stretchable, twistable, and foldable, having a diameter in a non-expanded state of on the order of 1" to 2" and a diameter of several inches in an expanded state so that it is sized and configured to surround and bind a pony tail in place;

a connection securing the first end of the length of hair strands to a portion of the elastic loop so that the remainder of the elastic loop is free and available to surround and bind a pony tail.

2. The hair piece of claim 1 wherein the hair strands at the second end of the length are glued together.

3. The hair piece of claim 1 wherein the hair strands comprise hundreds of artificial hair strands.

4. The hair piece of claim 1 wherein the hair strands are synthetic.

5. The hair piece of claim 1 wherein the hair strands are selected from the set comprising synthetic, human, and animal hair.

6. The hair piece of claim 1 the hair strands are selected to match a characteristic of a user's own hair.

7. The hair piece of claim 6 wherein the characteristic is selected from the set comprising color, curliness, texture, and style.

8. The hair piece of claim 1 wherein the hair strands are braided.

9. The hair piece of claim 1 wherein the length is over five inches from first to second ends when fully extended.

10. The hair piece of claim 1 wherein the elastic loop is made of natural or artificial rubber and is covered by a stretchable fabric.

11. The hair piece of claim 1 wherein the connection comprises a webbing wrapped around the elastic loop and with the hair strands sewn into the webbing.

12. The hair piece of claim 11 wherein the webbing is secured to the elastic loop by thread or cord.

13. The hair piece of claim 1 further comprising a wrapping around the second end of the length securing the material in place.

14. A removable hair piece comprising:

a length of hair strands having a first end and a second end;

an elastic loop which is stretchable, twistable, and foldable;

a connection securing the first end of the length of hair strands to a portion of the elastic loop and further comprising a hair pin connected at or near the second end of the length of hair strands.

15. The hair piece of claim 14 wherein the hair pin is connected by a thread or cord at or near the second end of the length of hair strands.

16. An apparatus for securing and wrapping the base of a pony tail comprising:

a stretchable, twistable, and foldable elastic loop, having a diameter in a non-expanded state of on the order of 1" to 2" and a diameter of several inches in an expanded state so that it is sized and configured to surround and bind a pony tail in place;

a material connected to one portion of the elastic loop;

a collection of hair strands independent from a user's intact hair connected to the material so that the remainder of the elastic loop is free and available to surround and bind a pony tail;

so that the combination can be used both to secure the base of the pony tail with the elastic loop, and then wrap and conceal the elastic loop with the hair strands to give the appearance that the hair strands have secured the pony tail base.

17. A method of securing and wrapping the base of a pony tail formed with a user's intact hair comprising:

gathering at least a portion of the user's intact hair into a pony tail;

securing the base of the pony tail with a stretchable, twistable, and foldable elastic to which is connected an hair extension which is independent of the user's intact hair;

wrapping the artificial hair extension around the elastic securing the base of the pony tail.

18. The method of claim 17 further comprising pinning the hair extension in place.

19. The method of claim 17 wherein the color of the hair extension is selected to match the color of the user's hair.

20. The method of claim 17 wherein the hair extension is braided.

21. The method of claim 17 wherein a securing pin is attached to the hair extension.

* * * * *

UNITED STATES PATENT AND TRADEMARK OFFICE

CERTIFICATE OF CORRECTION

PATENT NO. : 5,899,211
DATED : March 30, 1999
INVENTOR(S) : Theresa A. Maudie et al.

It is certified that error appears in the above-identified patent and that said Letters Patent is hereby corrected as shown below:

Column 8,
Line 25, delete "sidewalls" and add -- sidewall --.
Line 32, delete "2" and add -- 8 --.

Signed and Sealed this

Seventeenth Day of June, 2003

JAMES E. ROGAN
*Director of the United States Patent and Trademark Office*

UNITED STATES PATENT AND TRADEMARK OFFICE

CERTIFICATE OF CORRECTION

PATENT NO. : 5,899,211
DATED : May 4, 1999
INVENTOR(S) : Thomas A. Brown

It is certified that error appears in the above-identified patent and that said Letters Patent is hereby corrected as shown below:

This certificate supersedes certificate of correction issued June 17, 2003, the number was erroneously mentioned and should be vacated since no certificate of correction was granted.

Signed and Sealed this

Fifth Day of July, 2005

JON W. DUDAS
*Director of the United States Patent and Trademark Office*